US006988908B2

(12) United States Patent
Zhang et al.

(10) Patent No.: US 6,988,908 B2
(45) Date of Patent: Jan. 24, 2006

(54) CABLE END CONNECTOR ASSEMBLY WITH A PRESSING DEVICE

(75) Inventors: Hongbo Zhang, Kunsan (CN); Yi Sheng Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/902,766

(22) Filed: Jul. 30, 2004

(65) Prior Publication Data

US 2005/0026492 A1 Feb. 3, 2005

(30) Foreign Application Priority Data

Jul. 30, 2003 (TW) ..... 92213896 U

(51) Int. Cl.
*H01R 13/627* (2006.01)

(52) U.S. Cl. ..... 439/358

(58) Field of Classification Search ..... 439/358, 439/357, 350

See application file for complete search history.

(56) References Cited

U.S. PATENT DOCUMENTS

| | | | | |
|---|---|---|---|---|
| 5,197,901 A | | 3/1993 | Hashiguchi | |
| 5,860,826 A | * | 1/1999 | Chang | 439/358 |
| 6,146,205 A | * | 11/2000 | Lai | 439/358 |
| 6,165,017 A | * | 12/2000 | Kuo | 439/357 |

* cited by examiner

*Primary Examiner*—Ross Gushi
(74) *Attorney, Agent, or Firm*—Wei Te Chung

(57) ABSTRACT

A cable end connector assembly (100) includes a cable end connector (2) and a cable (1). The cable end connector comprises an insulative housing (20), a protection device (40), and a pressing device (50). The insulative housing receives a plurality of contacts (26) therein. The protection device encloses the insulative housing and defines recesses at both sides thereof. The pressing device is assembled to the both sides of the protection device and has a pair of holding members (5) and pressing buttons (6). Each holding member includes a locking window (51) mating with a complementary connector, and a retention portion (56). Each pressing buttons includes a body portion (60) receiving the retention portion of the holding member, and a pressing portion (66) projecting outwardly from the body portion and having an obstructing portion (65). The cable connects the contacts for an electrical connection.

17 Claims, 4 Drawing Sheets

CABLE END CONNECTOR ASSEMBLY WITH A PRESSING DEVICE

BACKGROUND OF THE INVENTION

1. Field of the Invention

The present invention relates to a cable end connector assembly, and more particularly to a cable end connector assembly having a pressing device to disengage from a complementary connector.

2. Description of Prior Art

With the development of computers, in order to facilitate used of added functions, many peripheral devices to the computers are commonly used to support the functions. A printer, a scanner, and a digital camera are examples of said peripheral devices. Thus, a secure connection between a cable connector assembly and a complementary connector is very important, especially to a portable computer. A vibratory environment may cause a break down of a connection between connecting connectors, so electric or signal transmitting will be influenced. Now, it is known to use curve-shaped elastic hooks to ensure a firm connection. U.S. Pat. No. 5,197,901 discloses such a lock-equipped connector assembly comprising a connector body, a plurality of contacts retained in the connector body, a pair of back shells to counter electromagnetic interference (EMI), a pair of lock springs, a pair of upper and lower hoods, and a bushing. Each hood member has a movable operating section for operating the lock spring to release the hook-shaped section from the lock member.

In the patent mentioned above, however, when the pressing force is too large, the locking spring will exceed the limit of the elastic deformation such that the locking spring will be damaged.

Hence, an improved cable end connector assembly is required to overcome the disadvantages of the prior art.

SUMMARY OF THE INVENTION

An object of the present invention is to provide a cable end connector assembly having a simple and improved pressing device means with a holding member and a pressing button assembled together to prevent a damage to the holding member.

In order to achieve the objects set forth, a cable end connector assembly includes a cable end connector and a cable.

The cable end connector comprises an insulative housing receiving a plurality of contacts therein, a protection device enclosing the insulative housing and defining recesses at both sides thereof, a pressing device assembled to the recesses at the both sides of the protection device and having a pair of holding members and pressing buttons. Each holding member includes a locking window mating with a complementary connector, and a retention portion. Each pressing button includes a body portion receiving the retention portion of the holding member, a pressing portion projecting outwardly from the body portion, and the pressing portion having an obstructing portion. The cable connects the contacts for an electrical connection.

Other objects, advantages and novel features of the invention will become more apparent from the following detailed description when taken in conjunction with the accompanying drawings.

DETAILED DESCRIPTION OF THE INVENTION

Figure 1:
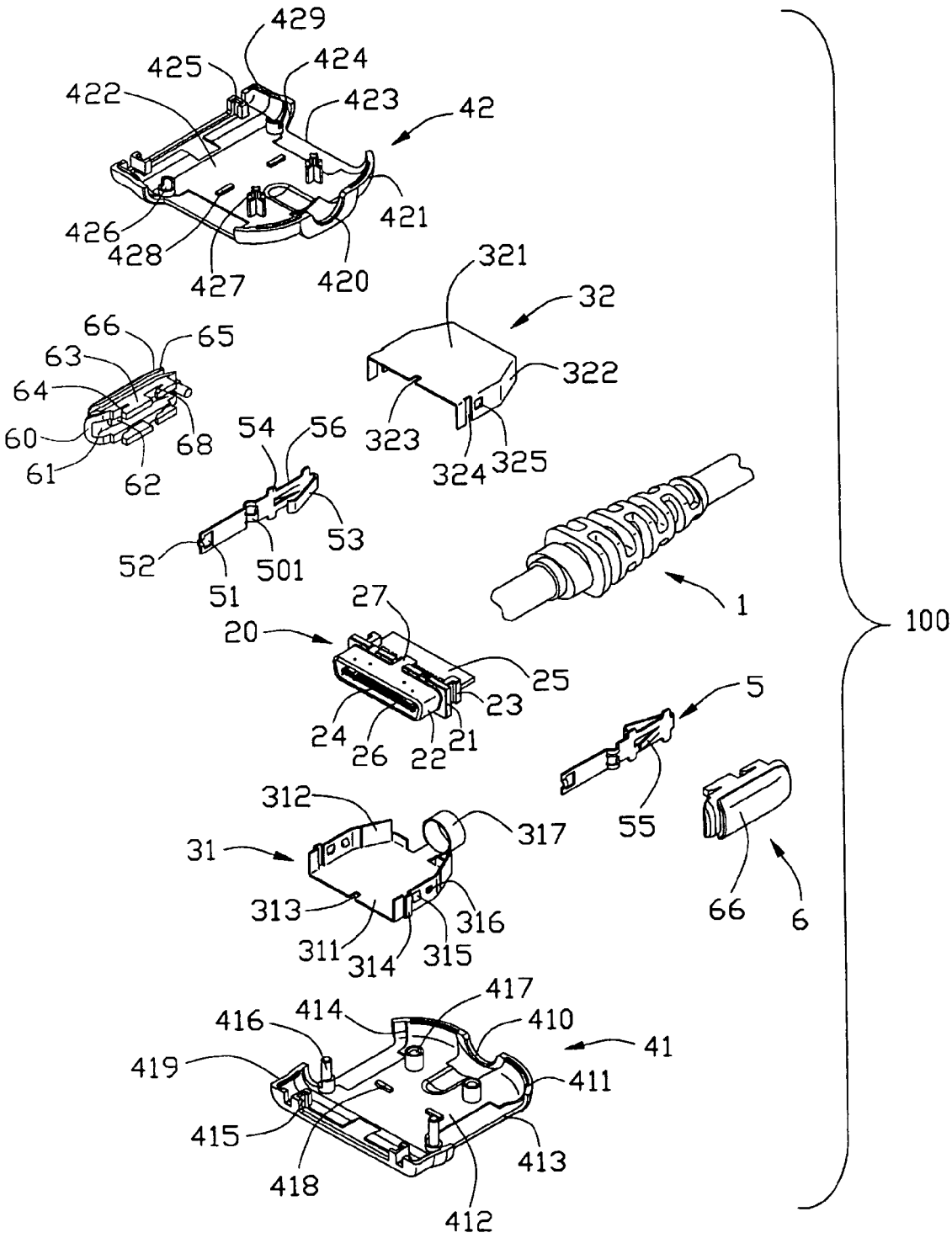
FIG. 1 is an exploded, perspective view of a cable end connector assembly in accordance with the present invention.

Referring to FIGS. 1 to 4, a cable end connector assembly 100 in accordance with the present invention comprises an cable end connector 2 and a cable 1. The cable end connector 2 comprises an insulative housing 20, a shielding device 30, a protection device 40, and a pressing device 50.

The insulative housing 20 comprises a rectangular base 21, a D-shaped mating portion 22 extending forwardly from the base 21, and a mating arm 27 extending rearwardly from the mating portion 22 and extending through the base 21. A tongue plate 24 is received in the mating portion 22 and extends forwardly from the base 21. The tongue plate 24 defines a plurality of passageways on a top surface for receiving corresponding contacts 26. A rear portion 25 extends rearwardly from a middle portion of the base. The rear portion 25 forms a pair of L-shaped stopping portions 23 at two side ends adjacent to the base 21.

Referring to FIG. 1, the shielding device 30 comprises a first shielding portion 31, and a second shielding portion 32 mating with the first shielding portion 31. The shielding device 30 encloses the insulative housing 20. The structures of the first and second shielding portion 31, 32 are similar. Each shielding portion comprises a top wall 311, 321, and two side walls 312, 322. The side walls 312, 322 respectively define a pair of projections 314 and depressions 324 for mating with the L-shaped stopping portions 23. Therefore, the first and second shielding portions 31, 32 are assembled to the insulative housing 20 securely. The top walls 311, 321 respectively define a recess 313, 323 at a front end thereof. The front ends of the top walls 311, 321 enclose and contact the mating arm 27 for achieving an electrical connection between the mating portion 22 and the shielding device 30. The first shielding portion 31 further comprises a cylinder-shaped securing portion 317 extending rearwardly from a rear end of the top wall 311 for securing the cable 1. The side walls 312 of the first shielding portion 31 each form a protrusion 315 and an elastic tab 316. The side walls 322 of the second shielding portion 32 each define an indentation 325 corresponding to the protrusion 315. The elastic tabs 316 of side walls 312 lean on lateral sides of the base 21 for preventing a malposition between the insulative housing 20 and the shielding device 30. By such design, electromagnetic interference can be eliminated, and the static electrical currents are guided to the mating portion 22 via the mating arm 27, when the cable end connector assembly 100 is mated with a complementary connector (not shown). The static electric currents are guided to outside of the connectors by a grounding path of the complementary connector for a good electrical connection.

Referring to FIG. 1, the protection device 40 comprises an upper and lower covers 41, 42, the upper and lower covers 41, 42 mating with to each other. The structures of the upper and lower covers 41, 42 are similar. Each cover 41, 42 comprises a bottom wall 412, 422, opposite side portions 419, 429, and a rear wall 411, 421. Each rear wall 411, 421 defines a semicircular recess 410, 420, the semicircular recesses 410, 420 together defining a circled-shaped cavity for receiving the securing portion 317 and installing the cable 1. A connecting area between the rear wall 411, 421 and the side portion 419, 429 defines a rectangular recess 413, 423. An inner surface adjacent to the rectangular recess 412, 423 defines a step 414, 424. A front end between the bottom wall 412, 422 and the side portion 419, 429 forms a pair of locking portion 415, 425 for receiving the base 21 and fixing the insulative housing 20 in the protection device 40.

The bottom wall 412, 422 forms a pair of rectangular holding portions 418, 428 at a center portion for securing the insulative housing 20 and the shielding device 30 in the protection device 40. The upper cover 41 forms a pair of guiding posts 416 at side portions 419 adjacent to the front end. The lower cover 42 defines a pair of receiving space 426 receiving the guiding posts 416 at a corresponding position. In addition, the upper cover 41 defines a pair of locking members 417 at the rear portion. Each locking member 417 is hollow. The lower cover 42 forms a pair of locking posts 427 corresponding to the locking members 417 of the upper cover 41. Therefore, the upper and lower covers 41, 42 are mated securely.

Figure 2:
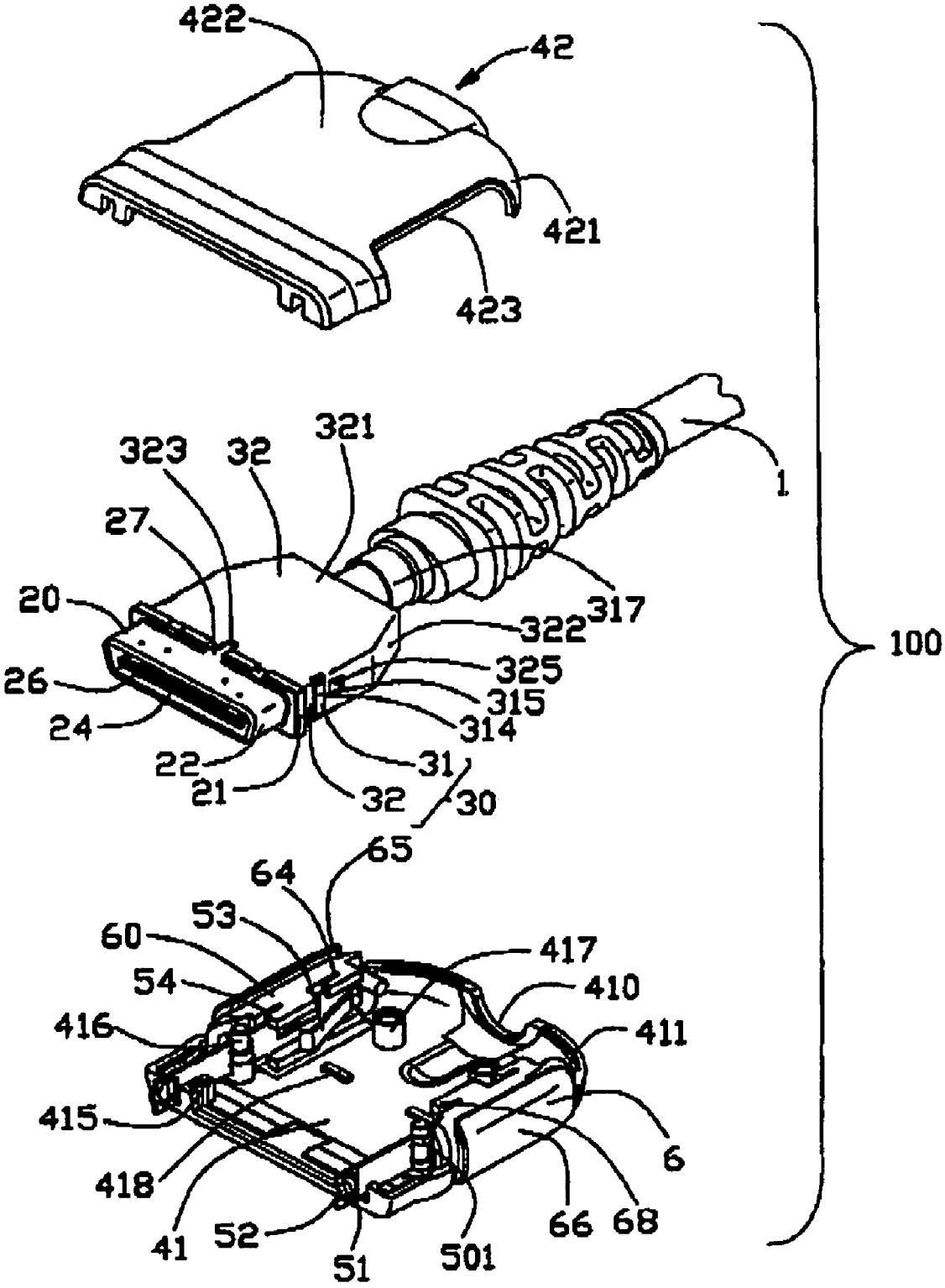
FIG. 2 is a partly assembled, perspective view of the cable end connector assembly of FIG. 1.

Referring to FIGS. 1 and 2. The pressing device 50 comprises a pair of holding members 5 and pressing buttons 6. Each holding member S is a rectangular metal sheet and comprises a locking window 51, a pivoting portion 501 extending rearwardly from the locking window 51, a retention portion 56 extending rearwardly from the pivoting portion 501, and a spring portion 53 extending rearwardly and bent forwardly from a rear end of the retention portion 56. The locking window 51 is a rectangular opening and defines a guiding aperture 52 at a front end thereof The pivoting portion 501 defines a hole (not labeled). The guiding post 416 is pivoted on and extends through the hole. The retention portion 56 forms two pairs of ribs 54 at opposite top and bottom ends, and a stopping arm 55 stamped from a middle portion of the retention portion 56 and extending along a direction same as the spring portion 53.

The pressing buttons 6 are received in the recesses 413, 423 respectively. Each pressing button 6 comprises a body portion 60, two pairs of L-shaped bulges 68 at two longitudinal sides 63 of body portion 60, and a pressing portion 66 projecting outwardly from the body portion 60. A locking channel 64 is defined between each bulge 68 and the longitudinal side 63 thereof. Front and rear portions of the body portions 60 are arcuate and bent inwardly. An inner surface adjacent to the front portion of the body portion 60 defines a locking projection 62. The body portion 60 and the two longitudinal sides together define a receiving space 61. An obstructing portion 65 extends outwardly from and is higher than the body portion 60.

In assembly, the holding members 5 are first assembled to the pressing buttons 6 respectively, with each holding member 5 inserting into the receiving space 61 of the body portion 60 along a front-to-rear direction and received therein. The stopping arm 55 slides along a surface and finally rests against a rear end of the locking projection 62. The ribs 54 mate with the locking channels 64 respectively for preventing the holding members 5 from moving outwardly or inwardly or backwardly. Besides, the two longitudinal sides 63 can prevent the holding member 5 from moving upwardly or downwardly. The stopping arms 55 mate with the locking projections 62 respectively for avoiding a forward movement of the holding member 5. Therefore, a firm cooperation between the holding member 5 and the pressing button 6 can be ensured.

Figure 3:
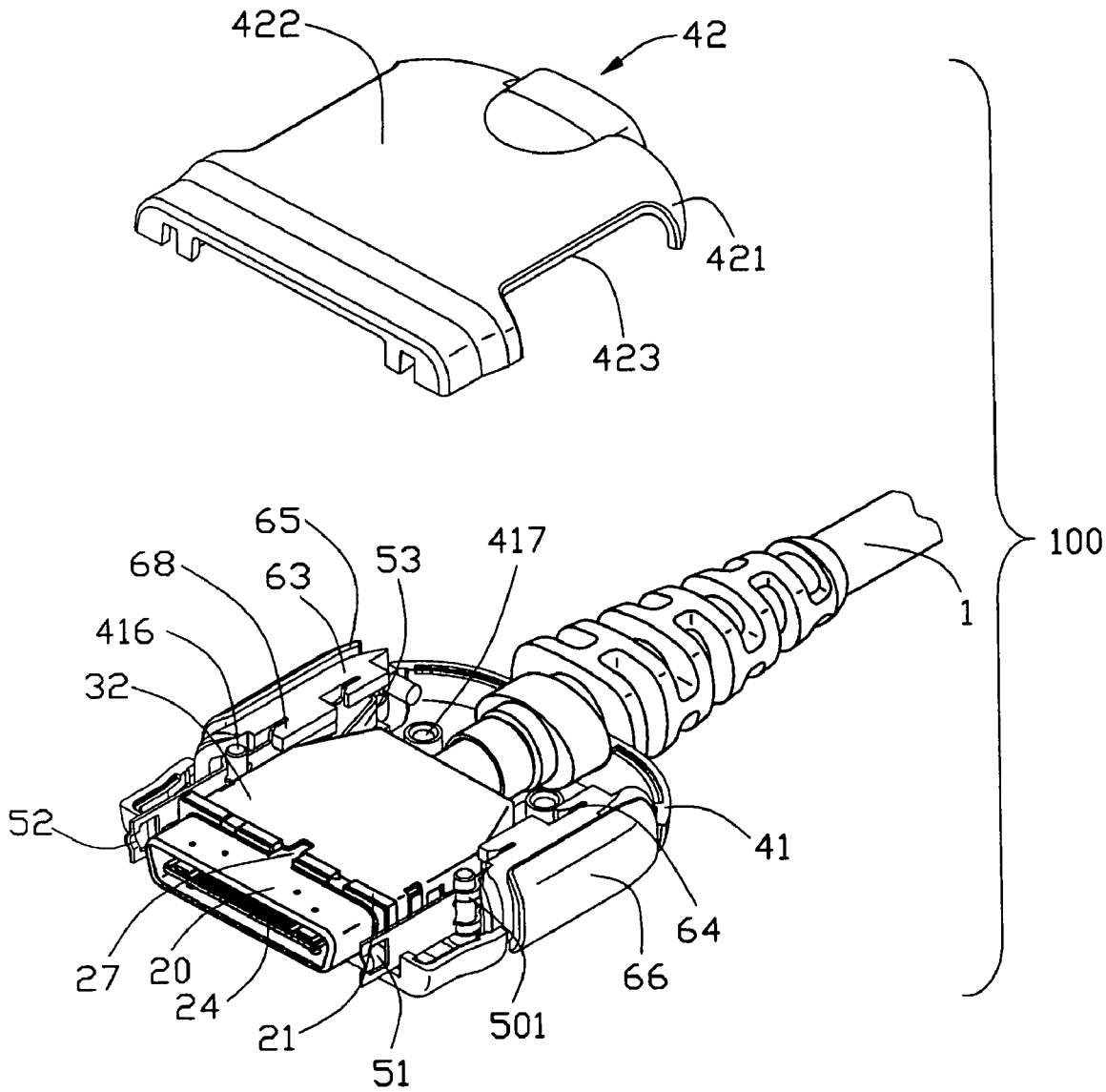
FIG. 3 is an assembled, perspective view of the cable end connector assembly with a separate upper cover of FIG. 2.
Figure 4:
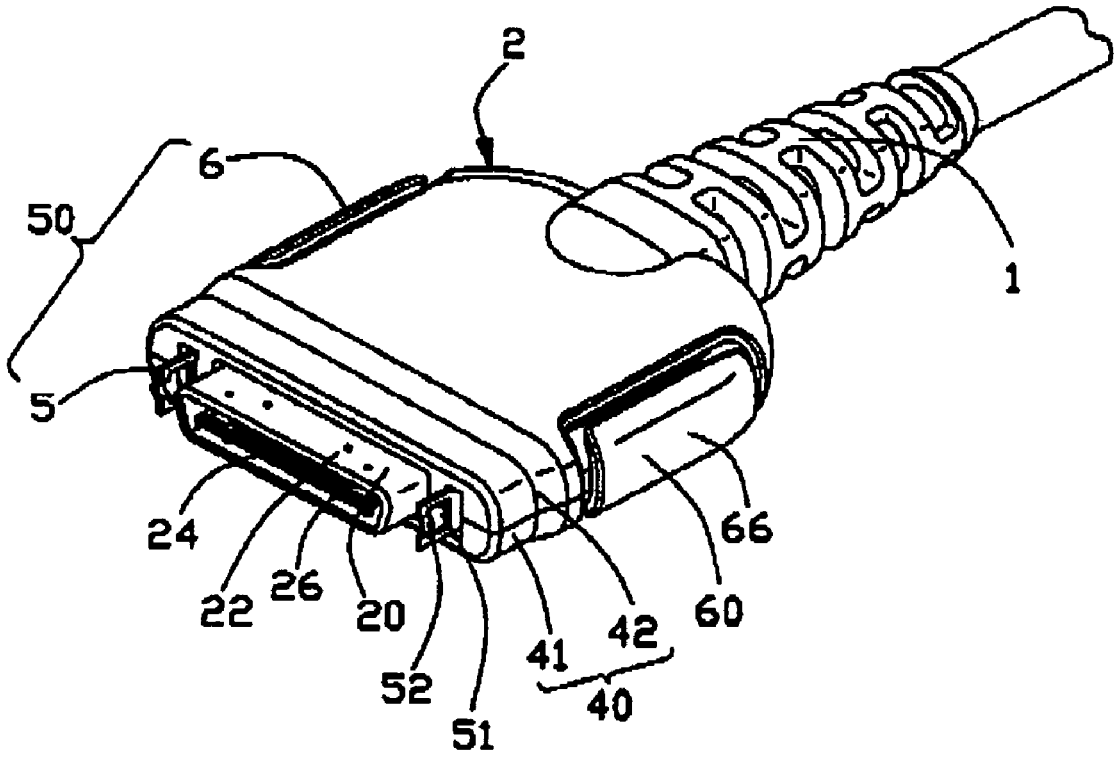
FIG. 4 is an assembled, perspective view of the cable end connector assembly of FIG. 3.

Referring to FIGS. 3 and 4. Secondly, the pressing device 50 is assembled to the protection device 40. The spring portion 53 of the holding member 5 is leaned on an outside end of the shielding device 30. The body portions 60 mate with the recesses 413, 423 of the protection device 40, respectively. The pressing buttons 6 are secured with the protection device 40 securely by mating the steps 414, 424 with the front portions of the body portions 60.

A front part of the cable 1 inserts into the shielding device 30 and extends through the securing portion 317 of the first shielding portion 31. The cable 1 engages the contacts 26 of the insulative housing 20 for an electrical connection. The cable 1 connects the cable end connector 2 firmly by the semicircular recesses 410, 420 of the upper and lower covers 41, 42 mating to each other.

When the cable end connector assembly 100 is mated with the complementary connector, the guiding apertures 52 mate with corresponding members (not shown) of the complementary connector. When disengaging the cable end connector assembly 100 from the complementary connector, pressing the pressing portions 66 of the pressing buttons 6 will cause an elastic deformation to the spring portions 53. The holding members 5 are pivoted on the guiding posts 416, therefore, the Jacking windows 51 can disengage from the complementary connector. The bulge 68 can prevent an over pressure of the pressing buttons 6 to damage the holding members 5. When an action of pressing the buttons 6 is finished, the spring portions 53 can provide an elastic force to return the holding members 5 to initial states. At the same time, the pressing buttons 6 mate with the recesses 413, 423 securely and enclose two sides of the protection device 40 for preventing dirt from entering into the interior of the cable end connector 2.

During a releasing operation between the cable end connector assembly 100 and the complementary connector, the pressing buttons 6 will be pressed. When the obstructing portions 65 contact with the side portions of the protection device 40, the pressing action will be stopped, so the holding members 5 will not be damaged due to the over pressure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

a cable end connector comprising:

an insulative housing receiving a plurality of contacts therein;

a protection device enclosing the insulative housing and defining recesses at both side thereof;

a pressing device assembled to the recesses at the both sides of the protection device and having a pair of holding members and pressing buttons;

each holding member including a locking window mating with a complementary connector, and a retention portion; each pressing button including a body portion receiving the retention portion of the holding member, a pressing portion projecting outwardly from the body portion, the pressing portion having an obstructing portion; and a cable connecting the contacts for an electrical connection;

wherein the protection device comprises opposite upper and lower covers having a number of locking members and corresponding locking posts for mating with the upper and lower covers securely;

wherein the lower cover forms a pair of guiding posts mating with the pivoting portions of the holding members.

2. The cable end connector assembly as claimed in claim 1, wherein the obstructing portion is raised from the body portion of the pressing button.

3. The cable end connector assembly as claimed in claim 1, wherein the body portion of the pressing button comprises a locking projection in an inner surface thereof, and a number of bulges at longitudinal sides thereof, the bulge and the longitudinal side together defining a locking channel.

4. The cable end connector assembly as claimed in claim 1, wherein each holding member comprises a pivoting portion between the locking window and the retention portion, and a spring portion extending rearwardly and bent inwardly from the retention portion.

5. The cable end connector assembly as claim 4, wherein the retention portion of the holding member comprises a number of ribs mating with the locking channels, and a stopping arm leaning an the locking projection.

6. The cable end connector assembly as claim 1, further comprising a shielding device having first and second shielding portions together enclosing the insulative housing, each shielding portion having a top wall defining a recess at a front end thereof.

7. The cable end connector assembly as claimed in claim 6, wherein a securing portion extends rearwardly from a rear end of the first shielding device for securing the cable.

8. The cable end connector assembly as claimed in claim 6, wherein the first and second shielding portions respectively form a pair of projections and depressions for securing the insulative housing and the shielding device.

9. The cable end connector assembly as claimed in claim 1, wherein the insulative housing includes a rectangular base, and a mating portion extending forwardly from the base and receiving a tongue plate.

10. The cable end connector assembly in claim 9, wherein the upper and lower covers have bottom walls forming corresponding locking portions receiving the base of the insulative housing.

11. The cable connector assembly as claimed in claim 9, wherein a pair of stopping portions extending rearwardly are formed at both sides of the base.

12. The cable end connector assembly as claimed in claim 9, wherein a mating arm extends rearwardly from the mating portion and extends through the base.

13. The cable end connector assembly as claimed in claim 12, wherein the waxing arm is enclosed by the recesses of the first and second shielding portions for achieving an electrical connection between the mating portion and shielding device.

14. A cable end connector assembly comprising:

a cable end connector comprising:

an insulative housing receiving a plurality of contacts therein;

a protection device enclosing the insulative housing and defining recesses at both sides thereof;

a pressing device assembled to the recesses at the both sides of the protection device and having a pair of holding members and pressing buttons;

each holding member including a pivotal locking section mating with a complementary connector, and a retention portion;

each pressing button including a body portion assembled to the retention portion of the holding member, a pressing portion having an obstructing portion adapted to abut against the protection device when said pressing button is moved from an outer position to an inner position for preventing the holding member from being damaged due to over pressure; and a cable connecting the contacts for an electrical connection.

15. The assembly as claimed in claim 14, wherein a spring device is provided to urge said pressing button toward the outer position.

16. The assembly as claimed in claim 14, wherein said spring integrally extends from the pressing device, and abuts against one of the housing and the protection device.

17. A cable end connector assembly comprising:

a cable end connector comprising:

an insulative housing receiving a plurality of contacts therein;

a protection device enclosing the insulative housing and defining recesses at both side thereof;

a pressing device assembled to the recesses at the both sides of the protection device and having a pair of holding members and pressing buttons;

each holding member including a locking window mating with a complementary connector, and a retention portion; each pressing button including a body portion receiving the retention portion of the holding member, a pressing portion projecting outwardly from the body portion, the pressing portion having an obstructing portion; and a cable connecting the contacts for an electrical connection;

wherein the insulative housing includes a rectangular base, and a mating portion extending forwardly from the base and receiving a tongue plate;

wherein a mating arm extends rearwardly from the mating portion and extends through the base.

* * * * *